US008066070B2

(12) United States Patent
Springett et al.

(10) Patent No.: US 8,066,070 B2
(45) Date of Patent: Nov. 29, 2011

(54) BLOWOUT PREVENTERS AND METHODS OF USE

(75) Inventors: Frank Benjamin Springett, Spring, TX (US); James Dennis Brugman, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 12/883,469

(22) Filed: Sep. 16, 2010

(65) Prior Publication Data

US 2011/0000670 A1 Jan. 6, 2011

Related U.S. Application Data

(60) Continuation of application No. 12/151,279, filed on May 5, 2008, now Pat. No. 7,814,979, which is a division of application No. 11/411,203, filed on Apr. 25, 2006, now Pat. No. 7,367,396.

(51) Int. Cl.

| | |
|---|---|
| ***E21B 29/08*** | (2006.01) |
| ***E21B 43/112*** | (2006.01) |
| ***B26D 3/16*** | (2006.01) |
| *B26D 1/48* | (2006.01) |

(52) U.S. Cl. ..... 166/298; 166/55; 30/92; 83/454

(58) Field of Classification Search ..... 166/85.4; 251/1.1, 1.2, 1.3; 30/131, 233, 92; 29/81.16; 137/315.02; 225/29, 33, 37, 54, 71, 92, 97
See application file for complete search history.

(56) References Cited

U.S. PATENT DOCUMENTS

| | | | | |
|---|---|---|---|---|
| 2,178,698 | A | | 11/1939 | Penick et al. |
| 2,231,613 | A | * | 2/1941 | Burke ..... 251/1.3 |
| 2,304,793 | A | | 12/1942 | Bodine, Jr. ..... 166/298 |
| 2,592,197 | A | | 4/1952 | Schweitzer |
| 2,752,119 | A | | 6/1956 | Allen et al. |
| 3,040,611 | A | * | 6/1962 | Tournaire ..... 83/636 |
| 3,272,222 | A | | 9/1966 | Allen et al. |
| 3,399,728 | A | * | 9/1968 | Allan ..... 166/53 |
| 3,554,278 | A | | 1/1971 | Reistle, III et al. |
| 3,554,480 | A | * | 1/1971 | Rowe ..... 251/1.3 |

(Continued)

FOREIGN PATENT DOCUMENTS

CA 2649771 12/2006

(Continued)

OTHER PUBLICATIONS

West Engineering Services, Shear Ram Capabilities Study, Sep. 2004, pp. 2-2 and 3-6.*

(Continued)

*Primary Examiner* — Thomas Beach
*Assistant Examiner* — Kelly Shaw
(74) *Attorney, Agent, or Firm* — The JL Salazar Law Firm

(57) ABSTRACT

Methods and apparatuses for severing a wellbore tubular, the apparatus, in certain aspects, including: a first member movable toward a tubular to be severed; a second member with a second blade disposed opposite to the first member and movable toward the tubular; a first blade on the first member having a projection projecting from a center of a blade body with point structure on the projection for puncturing the tubular and cutting surfaces on the projection for cutting the tubular; and cutting surfaces, as needed, on the blade body adjacent the projection for cutting the tubular.

19 Claims, 15 Drawing Sheets

U.S. PATENT DOCUMENTS 3,561,526 A * 2/1971 Williams et al. ..... 166/55
3,647,174 A 3/1972 Lerouax ..... 251/1
3,670,761 A 6/1972 Lerouax ..... 137/315
3,716,068 A * 2/1973 Addison ..... 137/67
3,741,296 A 6/1973 Murman et al.
3,744,749 A 7/1973 Le Rouax
3,766,979 A 10/1973 Petrick ..... 166/55
3,863,667 A * 2/1975 Ward ..... 137/318
3,918,478 A 11/1975 Lerouax ..... 137/315
3,922,780 A * 12/1975 Green ..... 30/92
3,946,806 A 3/1976 Meynier, III
3,955,622 A 5/1976 Jones
4,007,797 A 2/1977 Jeter
4,043,389 A 8/1977 Cobb
4,057,887 A 11/1977 Jones et al.
4,119,115 A 10/1978 Carruthers ..... 137/318
4,132,265 A 1/1979 Williams, Jr. ..... 166/55
4,132,267 A 1/1979 Jones
4,140,041 A * 2/1979 Frelau ..... 89/1.14
4,215,749 A 8/1980 Dare et al. ..... 166/361
4,220,206 A 9/1980 Van Winkle
4,253,638 A 3/1981 Troxell, Jr.
4,313,496 A * 2/1982 Childs et al. ..... 166/55
4,341,264 A 7/1982 Cox et al.
4,347,898 A 9/1982 Jones
4,372,527 A 2/1983 Rosenbauch et al. ..... 251/1 A
4,392,633 A 7/1983 Van Winkle
4,416,441 A 11/1983 Van Winkle
4,437,643 A 3/1984 Brakhage, Jr. et al. ..... 251/1 A
4,492,359 A 1/1985 Baugh
4,504,037 A 3/1985 Beam et al.
4,508,313 A * 4/1985 Jones ..... 251/1.3
4,516,598 A 5/1985 Stupak
4,518,144 A 5/1985 Vicic et al. ..... 251/1 A
4,519,577 A * 5/1985 Jones ..... 251/62
4,523,639 A * 6/1985 Howard, Jr. ..... 166/55
4,526,339 A * 7/1985 Miller ..... 251/1.3
4,537,250 A * 8/1985 Troxell, Jr. ..... 166/55
4,540,046 A * 9/1985 Granger et al. ..... 166/55
4,550,895 A 11/1985 Shaffer
4,558,842 A 12/1985 Peil et al.
4,612,983 A 9/1986 Karr, Jr.
4,646,825 A * 3/1987 Van Winkle ..... 166/55
4,647,002 A 3/1987 Crutchfield
4,690,033 A 9/1987 Van Winkle
4,690,411 A 9/1987 Van Winkle
4,699,350 A 10/1987 Herve ..... 25/1.3
4,923,005 A 5/1990 Laky et al.
4,923,008 A * 5/1990 Wachowicz et al. ..... 166/373
4,943,031 A 7/1990 Van Winkle
4,969,390 A 11/1990 Williams, III
5,002,130 A * 3/1991 Laky ..... 166/351
5,013,005 A * 5/1991 Nance ..... 251/1.3
5,025,708 A 6/1991 Smith et al.
5,056,418 A 10/1991 Granger et al.
5,178,215 A 1/1993 Yenulis et al.
5,199,493 A * 4/1993 Sodder, Jr. ..... 166/297
5,217,073 A * 6/1993 Bruns ..... 166/298
5,237,899 A * 8/1993 Schartinger ..... 83/454
5,360,061 A * 11/1994 Womble ..... 166/55
5,361,832 A 11/1994 Van Winkle
5,400,857 A * 3/1995 Whitby et al. ..... 166/297
5,505,426 A 4/1996 Whitby et al. ..... 251/1.3
5,515,916 A 5/1996 Haley
5,566,753 A 10/1996 Van Winkle et al.
5,575,451 A 11/1996 Colvin et al.
5,575,452 A 11/1996 Whitby et al.
5,588,491 A * 12/1996 Brugman et al. ..... 166/383
5,590,867 A 1/1997 Van Winkle
5,655,745 A 8/1997 Morrill
5,662,171 A * 9/1997 Brugman et al. ..... 166/383
5,735,502 A 4/1998 Levett et al.
5,778,918 A 7/1998 McLelland
5,863,022 A 1/1999 Van Winkle
5,897,094 A 4/1999 Brugman et al.
5,918,851 A 7/1999 Whitby
5,961,094 A 10/1999 Van Winkle
5,975,484 A 11/1999 Brugman et al.
6,006,647 A 12/1999 Van Winkle
6,012,528 A 1/2000 Van Winkle
6,016,880 A 1/2000 Hall et al.
6,113,061 A 9/2000 Van Winkle
6,158,505 A 12/2000 Araujo
6,164,619 A 12/2000 Van Winkle et al.
6,173,770 B1 * 1/2001 Morrill ..... 166/85.4
6,192,680 B1 2/2001 Brugman et al.
6,244,336 B1 * 6/2001 Kachich ..... 166/55
6,244,560 B1 6/2001 Johnson
6,276,450 B1 8/2001 Seneviratne
6,374,925 B1 4/2002 Elkins et al.
6,484,808 B2 11/2002 Jones et al.
6,510,897 B2 1/2003 Hemphill ..... 166/373
6,530,432 B2 * 3/2003 Gipson ..... 166/384
6,601,650 B2 8/2003 Sundararajan
6,718,860 B2 4/2004 Mitsukawa et al.
6,719,042 B2 * 4/2004 Johnson et al. ..... 166/55
6,742,597 B2 6/2004 Van Winkle et al.
6,834,721 B2 12/2004 Suro ..... 166/297
6,843,463 B1 1/2005 McWhorter et al. ..... 251/1.1
6,857,634 B2 2/2005 Araujo
6,964,303 B2 11/2005 Mazorow et al.
6,969,042 B2 11/2005 Gaydos ..... 251/1.3
6,974,135 B2 12/2005 Melancon et al.
7,011,159 B2 3/2006 Holland
7,011,160 B2 * 3/2006 Boyd ..... 166/379
7,044,430 B2 5/2006 Brugman et al.
7,051,989 B2 5/2006 Springett et al.
7,051,990 B2 5/2006 Springett et al.
7,055,594 B1 6/2006 Springett et al.
7,086,467 B2 * 8/2006 Schlegelmilch et al. ..... 166/298
7,108,081 B2 9/2006 Boyadjieff
7,165,619 B2 1/2007 Fox et al.
7,195,224 B2 3/2007 Le
7,207,382 B2 * 4/2007 Schaeper ..... 166/55
7,225,873 B2 * 6/2007 Schlegelmilch et al. ..... 166/298
7,234,530 B2 * 6/2007 Gass ..... 166/376
7,243,713 B2 7/2007 Isaacks et al.
7,270,190 B2 9/2007 McWhorter et al.
7,287,544 B2 10/2007 Seneviratne et al.
7,331,562 B2 * 2/2008 Springett ..... 251/1.3
7,350,587 B2 4/2008 Springett et al.
7,354,026 B2 4/2008 Urrutia ..... 251/1.3
7,360,603 B2 4/2008 Springett et al.
7,367,396 B2 * 5/2008 Springett et al. ..... 166/298
7,389,817 B2 * 6/2008 Almdahl et al. ..... 166/361
7,410,003 B2 8/2008 Ravensbergen ..... 166/384
7,434,369 B2 10/2008 Uneyama et al.
7,464,765 B2 12/2008 Isaacks et al.
7,487,848 B2 2/2009 Wells et al.
7,520,129 B2 4/2009 Springett
7,523,644 B2 4/2009 Van Winkle
7,673,674 B2 * 3/2010 Lam ..... 166/75.11
7,703,739 B2 * 4/2010 Judge et al. ..... 251/1.3
7,726,418 B2 6/2010 Ayling
7,748,473 B2 7/2010 Wells et al.
7,798,466 B2 9/2010 Springett et al.
7,814,979 B2 * 10/2010 Springett et al. ..... 166/298
2004/0124380 A1 7/2004 Van Winkle
2006/0076526 A1 4/2006 McWhorter et al.
2006/0113501 A1 * 6/2006 Isaacks et al. ..... 251/1.1
2006/0137827 A1 6/2006 Uneyama et al. ..... 156/510
2007/0102655 A1 * 5/2007 Springett ..... 251/1.3
2007/0137866 A1 6/2007 Ravensbergen et al. ..... 166/384
2008/0040070 A1 2/2008 McClanahan
2008/0185046 A1 8/2008 Springett et al.
2008/0189954 A1 * 8/2008 Lin ..... 30/92
2008/0265188 A1 10/2008 Springett et al.
2008/0267786 A1 10/2008 Springett et al.
2008/0286534 A1 * 11/2008 Springett et al. ..... 428/192
2009/0056132 A1 3/2009 Foote
2009/0205838 A1 8/2009 Springett
2010/0038088 A1 2/2010 Springett et al.

FOREIGN PATENT DOCUMENTS

EP 0 593 280 4/1994
EP 2013443 B1 6/2011
RU 2401935 C2 5/2010

OTHER PUBLICATIONS

National Oilwell Varco, "National Oilwell Varco Makes Spotlight Award List", Offshore Magazine, Apr. 2011, pp. 1.
National Oilwell Varco, OTC 2011: ShearMax Low Force Casing Shear Rams, p. 1.
Ben Casselman and Russell Gold, "Device's Design Flaw Let Oil Spill Freely", Business, Mar. 24, 2011, pp. 1-4.
Diane Langlely, "Drilling Contractor", Categorized, Jan. 28, 2011, p. 5.
Nell Lukosavich, "OTC 2011 Shifts Gears to Navigate Post-Macondo Landscape", World Oil, vol. 232 No. 4, pp. 1-8.
Frank Springett et al, "Low Force Shear Rams: The Future is More", SPE/IADC 140365, Mar. 1-3, 2011, pp. 1-9.
CIPO, Canadian Patent Application No. 2,649,771, Examination Report and Response, May 28, 2010, pp. 1-17.
EPO, European Patent Application No. 06820703.4-2315, First Examination Report and Response, Sep. 11, 2009, 47 pgs.
EPO, European Patent Application No. 06820703.4-2315, Notice of Allowance and Post Allowance Amendment, Aug. 3, 2010, 39 pgs.
EPO, European Patent Application No. 06820703.4-2315, Post Allowance Amendment including French and German language translations of amended claims, Dec. 13, 2010, 49 pgs.
EPO, European Divisional Patent Application No. 11168306.6-2315, Extended European Search Report, Aug. 4, 2011, pp. 1-6.
RU, Russian Patent Application No. 2008146406, Russian Amended Claim Set and Decision on Grant, May 12, 2010, 17 pgs.
EPO, PCT Patent Application No. PCT/GB2006/050478, International Search Report and Written Opinion, Apr. 4, 2007, 11 pgs.
EPO, PCT Patent Application No. PCT/GB2006/050478, Demand, Written Opinion Response and Amended Claims, Feb. 25, 2008, 32 pgs.
EPO, PCT Patent Application No. PCT/GB2006/050478, International Preliminary Report on Patentability, Aug. 12, 2008, 8 pgs.
Shear Ram Capabilities Study; West Engineering Services; pages Cover to 4-7 (23 pages); Sep. 2004.
Land & Marine Drilling; Cameron Iron Works Oil Tool Division; pages Cover, 1604, 1617, 1621: 1982-1983.
Varco's NXT Next Generation B0P Systems reduce the cost of Drilling: Varco: 6 pages; 2001.

* cited by examiner

FIG. 2A
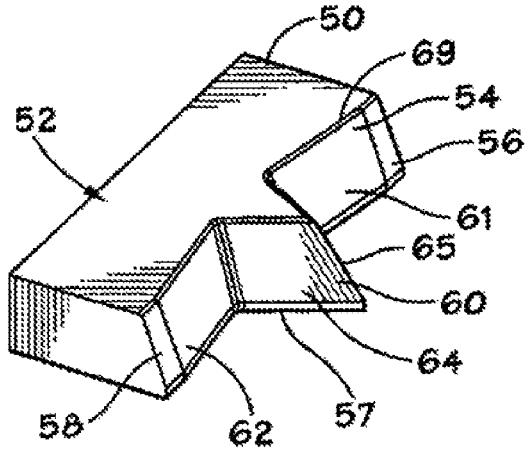
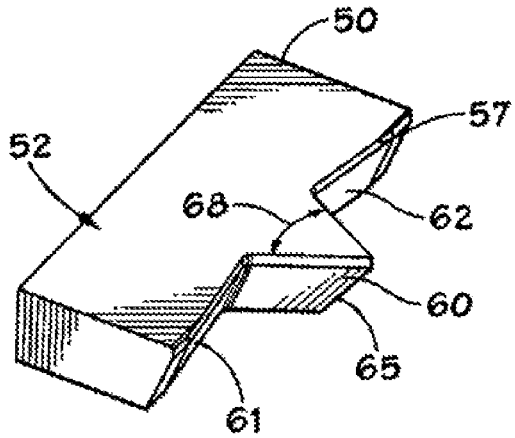
FIG. 2B
FIG. 2C
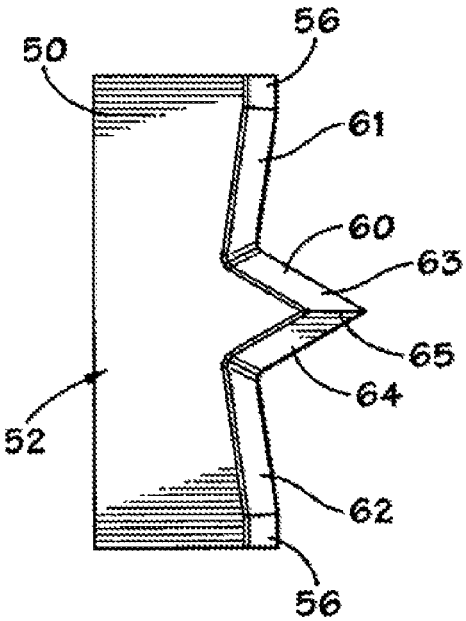
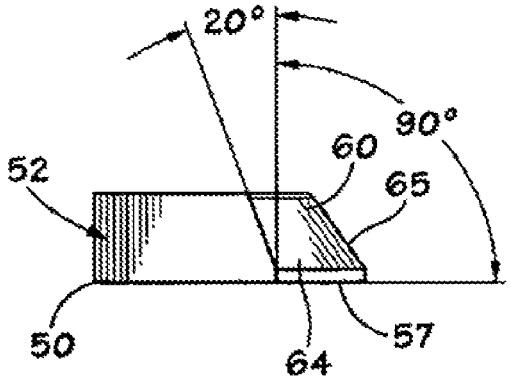
FIG. 2D

FIG. 4A
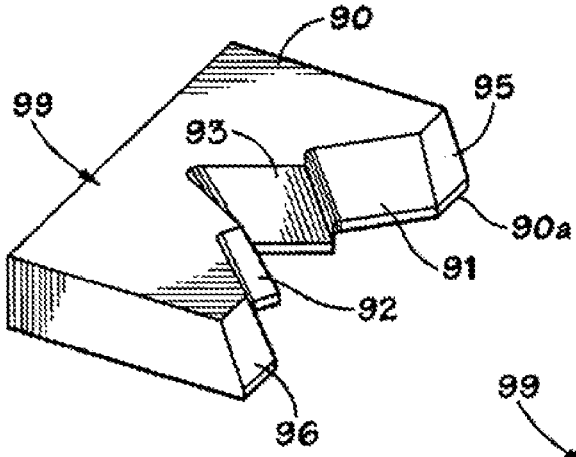
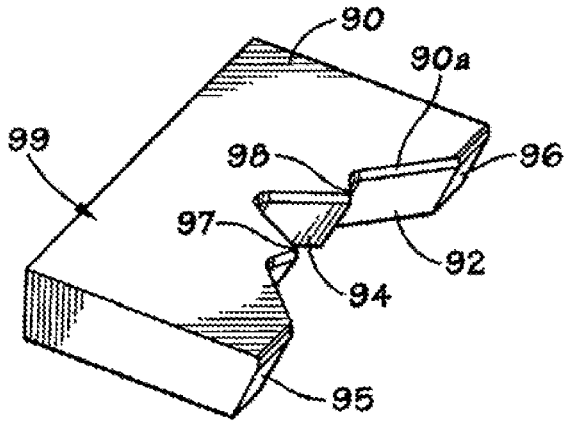
FIG. 4B
FIG. 4C
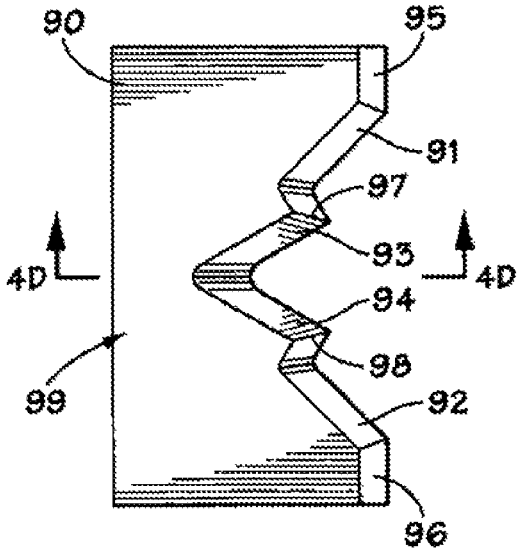
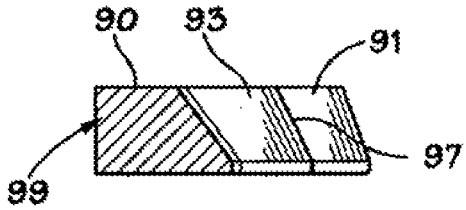
FIG. 4D

FIG. 5A
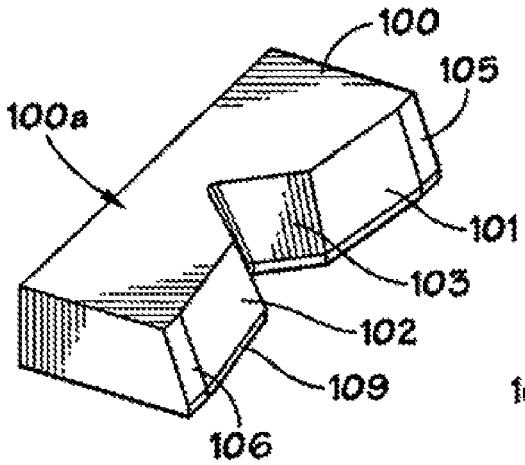
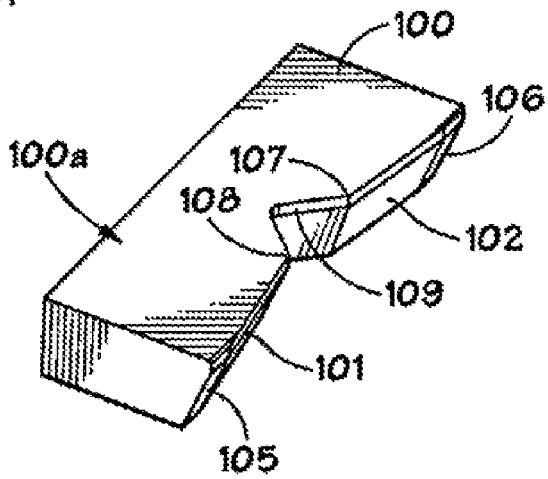
FIG. 5B
FIG. 5C
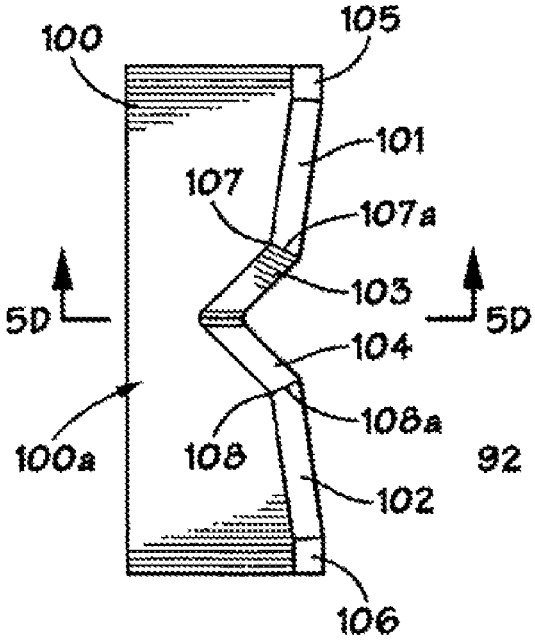
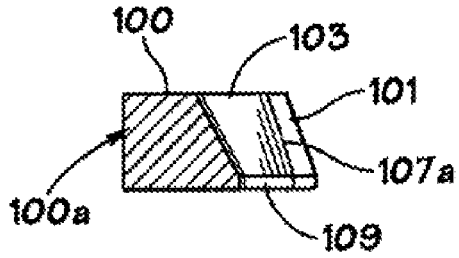
FIG. 5D

FIG. 6A
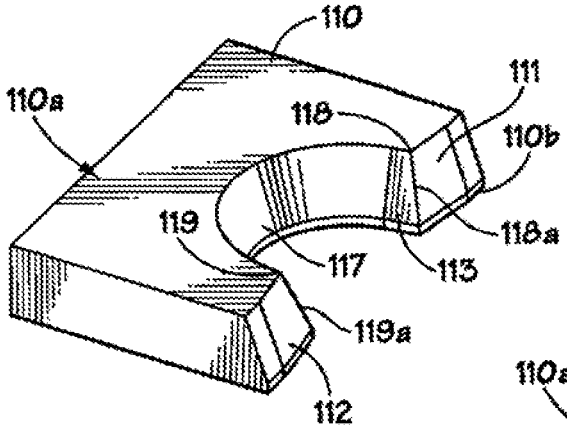
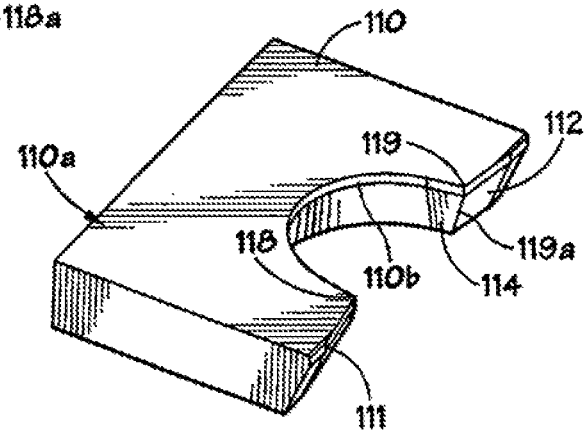
FIG. 6B
FIG. 6C
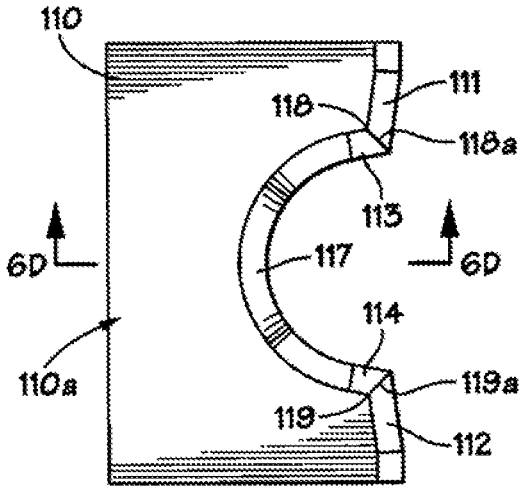
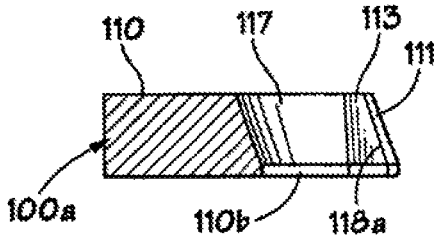
FIG. 6D

FIG. 7A
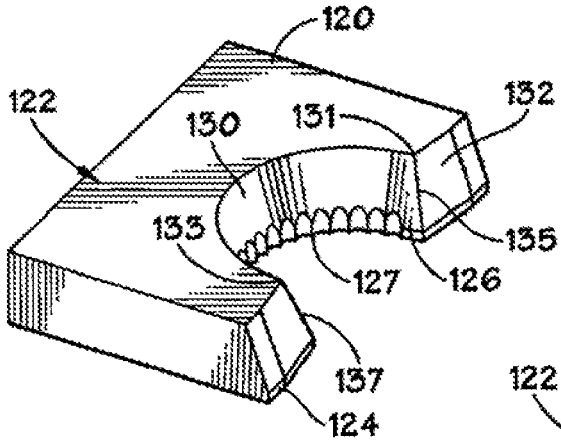
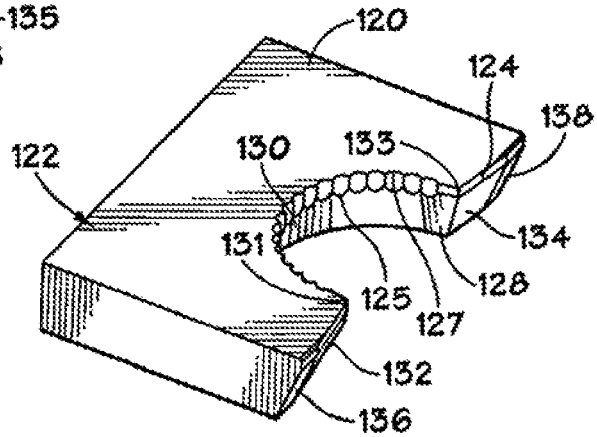
FIG. 7B
FIG. 7C
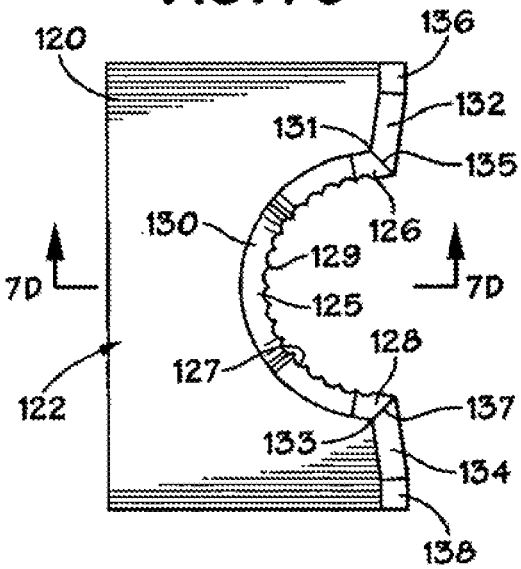
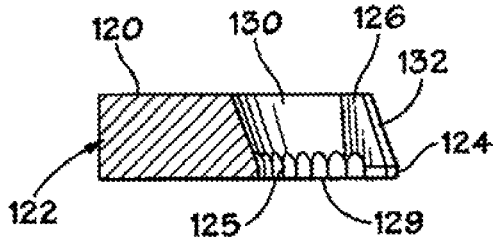
FIG. 7D

FIG. 9A
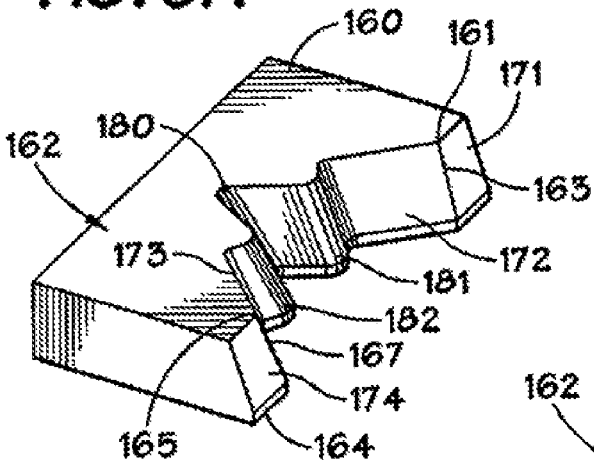
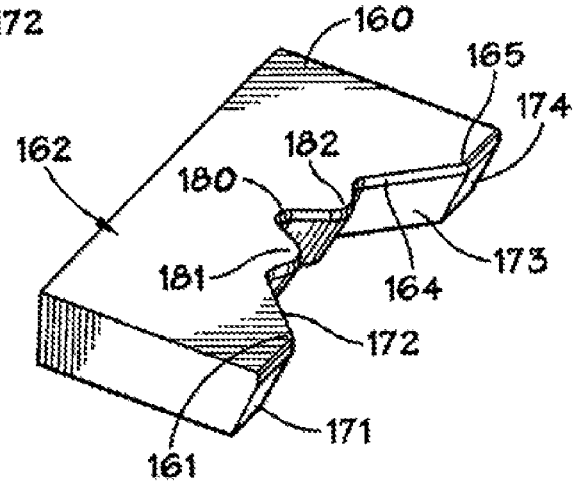
FIG. 9B
FIG. 9C
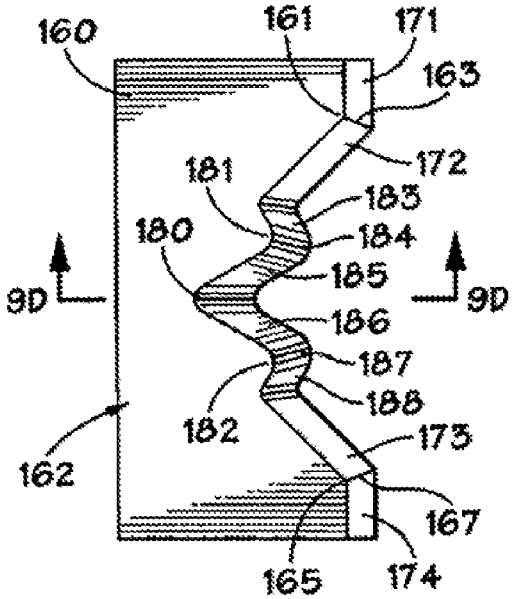
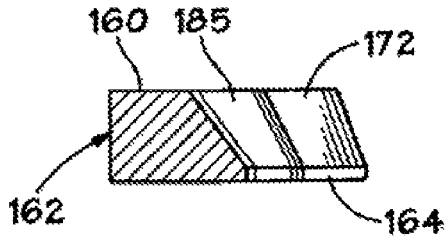
FIG. 9D

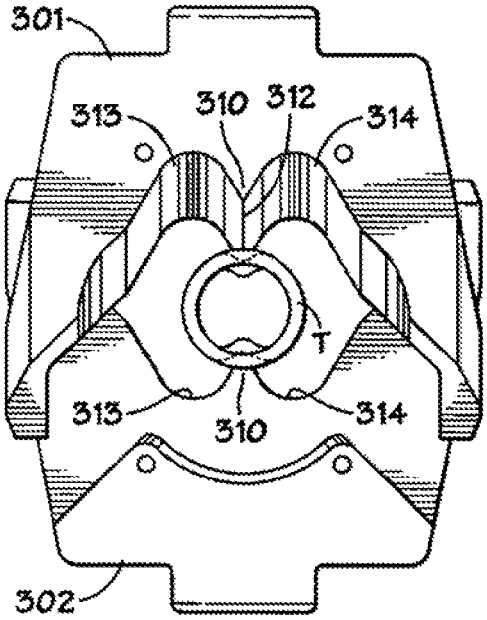
FIG. 15C
FIG. 15D
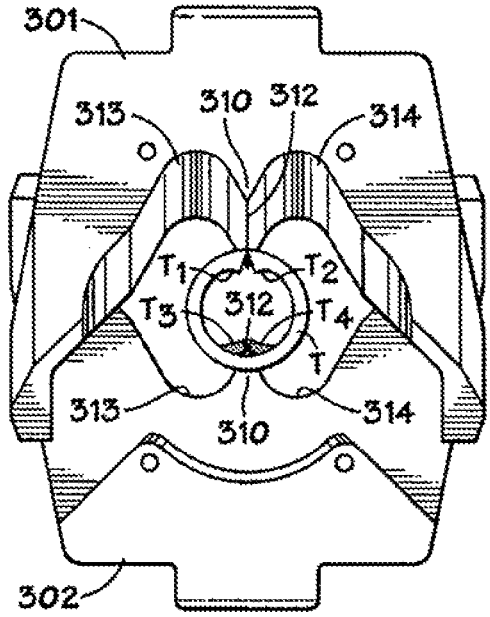
FIG. 15E
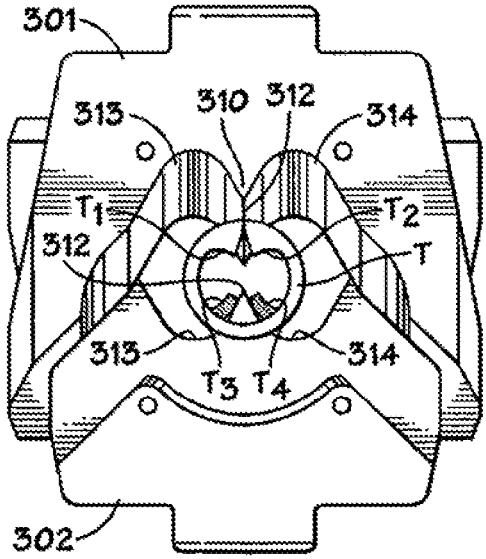

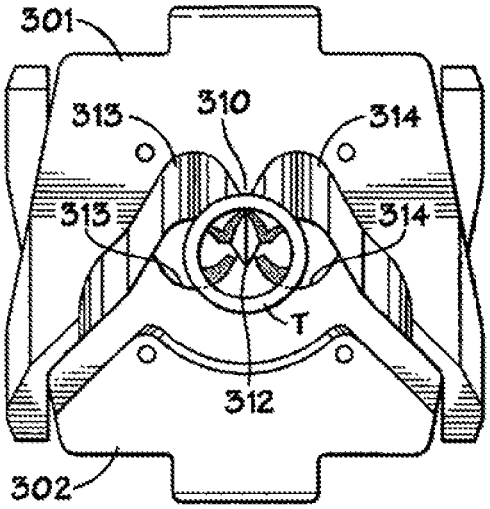
FIG. 15F
FIG. 15G
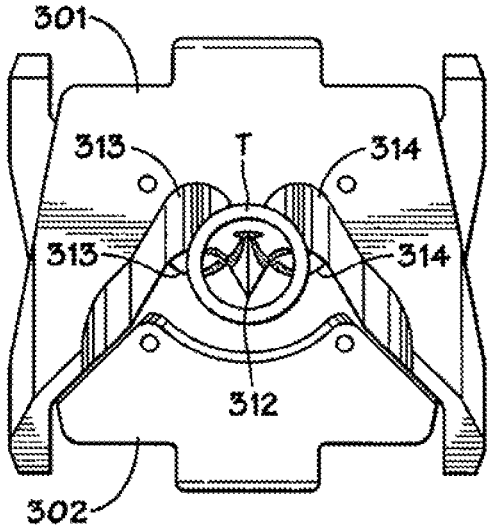
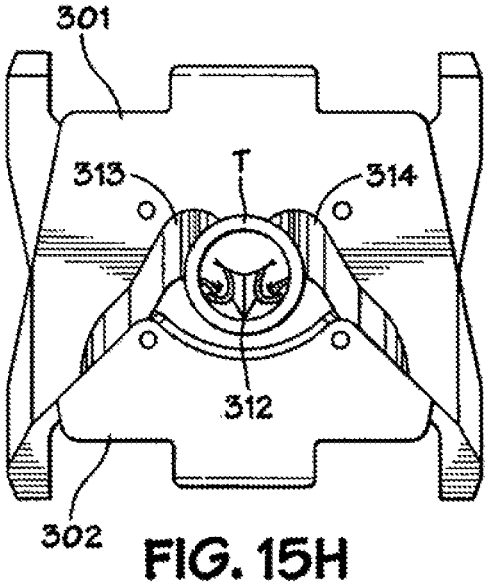
FIG. 15H

BLOWOUT PREVENTERS AND METHODS OF USE

CROSS-REFERENCE TO RELATED APPLICATIONS

This application is a continuation of U.S. application Ser. No. 12/151,279 filed May 5, 2008, now U.S. Pat. No. 7,814,979, which is a divisional of U.S. application Ser. No. 11/411,203 filed Apr. 25, 2006, now U.S. Pat. No. 7,367,396, the entire contents of which are hereby incorporated by reference.

BACKGROUND OF THE INVENTION

1. Field of the Invention

This present invention is directed to blowout preventers, to tubular-shearing blades for them, and methods of their use.

2. Description of Related Art

The prior art discloses a wide variety of blowout preventers and tubular-shearing blades for blowout preventer bonnets.

Typical blowout preventers have selectively actuatable ram bonnets secured to the body which are either pipe rams (to contact, engage, and encompass pipe and/or tools to seal a wellbore) or shear rams (to contact and physically shear a tubular, casing, pipe or tool used in wellbore operations). Rams, typically upon activation and subsequent shearing of a tubular, seal against each other over a center of a wellbore.

Blowout preventers and tubular-shearing blades for them are disclosed in many U.S. patents, including, but not limited to, U.S. Pat. Nos. 3,946,806; 4,043,389; 4,313,496; 4,132,267, 4,558,842; 4,969,390; 4,492,359; 4,504,037; 2,752,119; 3,272,222; 3,744,749; 4,253,638; 4,523,639; 5,025,708; 5,056,418; 5,400,857; 5,575,452; 5,655,745; and 5,918,851; 4,313,496; 4,550,895; 5,360,061; 4,923,005; 4,537,250; 5,515,916; 6,173,770; 3,863,667; 6,158,505; 5,575,451; 4,057,887; 5,505,426; 3,955,622; 3,554,278; and 5,013,005.

There has long been a need, recognized by the present inventor for a blowout preventer which can effectively and efficiently shear tubulars, e.g. tubulars used in well bore operations, including relatively large tubulars such as casing, drill collars, and drill pipe tool joints. In certain prior tubular shearing systems, a tool joint is located so that shearing rams do not encounter the tool joint, but shear only a relatively smaller portion of the tubular. Proper location takes time and, if a tool joint is improperly located, no or ineffectual shearing may result.

BRIEF SUMMARY OF THE INVENTION

In one aspect, the present invention discloses a blowout preventer and methods of its use, the blowout preventer having movable ram blocks, one or both of which has a cutting blade that produces one, two, or more holes, openings, or punctures of a tubular as the tubular is sheared to facilitate complete shearing of the tubular.

In certain aspects, the present invention discloses a blowout preventer with a body with a top, a bottom, and a bore therethrough from the top to the bottom; and ram apparatus movable within the body, the ram apparatus including two ram blocks, each with a cutting blade thereon according to the present invention.

In certain aspects, the present invention discloses cutting blades for blowout preventers, each blade with one, two, three or more projections, points or pronounced portions which form an opening hole or puncture area in a tubular to facilitate shearing of the tubular.

It is, therefore, an object of at least certain embodiments of the present invention to provide new, useful, unique, efficient, nonobvious blowout preventers and methods of their use, cutting blades for such blowout preventers, and methods of their use; and Such a blowout preventer with one or two cutting blades, at least one of which has at least one part for making a hole, etc. in a tubular to facilitate shearing of the tubular.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/ or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments are not to be used to improperly limit the scope of the invention which may have other equally effective or legally equivalent embodiments.

FIG. 2A is a top perspective view of a blade according to the present invention for a blowout preventer according to the present invention.

FIG. 2B is a bottom perspective view of the blade of FIG. 2A.

FIG. 2C is a top view of the blade of FIG. 2A.

FIG. 2D is a side view of the blade of FIG. 2A.

FIG. 4A is a top perspective view of a blade according to the present invention for a blowout preventer according to the present invention.

FIG. 4B is a bottom perspective view of the blade of FIG. 4A.

FIG. 4C is a top view of the blade of FIG. 4A.

FIG. 4D is a cross-section view along line 4D-4D of FIG. 4A.

FIG. 5A is a top perspective view of a blade according to the present invention for a blowout preventer according to the present invention.

FIG. 5B is a bottom perspective view of the blade of FIG. 5A.

FIG. 5C is a top view of the blade of FIG. 5A.

FIG. 5D is a cross-section view along line 5D-5D of FIG. 5A.

FIG. 6A is a top perspective view of a blade according to the present invention for a blowout preventer according to the present invention.

FIG. 6B is a bottom perspective view of the blade of FIG. 6A.

FIG. 6C is a top view of the blade of FIG. 6A.

FIG. 6D is a cross-section view along line 6D-6D of FIG. 6A.

FIG. 7A is a top perspective view of a blade according to the present invention for a blowout preventer according to the present invention.

FIG. 7B is a bottom perspective view of the blade of FIG. 7A.

FIG. 7C is a top view of the blade of FIG. 7A.

FIG. 7D is a cross-section view along line 7D-7D of FIG. 7A.

FIG. 9A is a top perspective view of a blade according to the present invention for a blowout preventer according to the present invention.

FIG. 9B is a bottom perspective view of the blade of FIG. 9A.

FIG. 9C is a top view of the blade of FIG. 9A.

FIG. 9D is a cross-section view along line 9D-9D of FIG. 9A.

FIG. 15C is a top view that illustrates a step in a method according to the present invention using apparatus according to the present invention.

FIG. 15D is a top view that illustrates a step in a method according to the present invention using apparatus according to the present invention.

FIG. 15E is a top view that illustrates a step in a method according to the present invention using apparatus according to the present invention.

FIG. 15F is a top view that illustrates a step in a method according to the present invention using apparatus according to the present invention.

FIG. 15G is a top view that illustrates a step in a method according to the present invention using apparatus according to the present invention.

FIG. 15H is a top view that illustrates a step in a method according to the present invention using apparatus according to the present invention.

DETAILED DESCRIPTION OF THE INVENTION

Figure 1A:
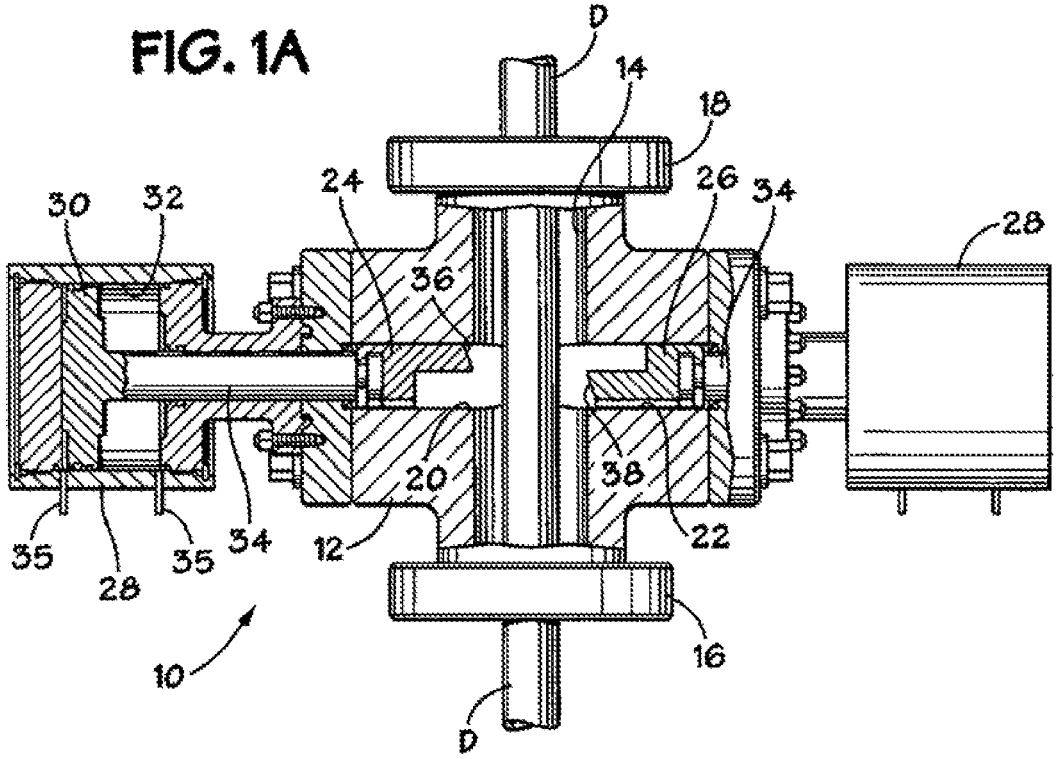
FIG. 1A is a side view, partially in cross-section, of a blowout preventer according to the present invention.
Figure 1B:
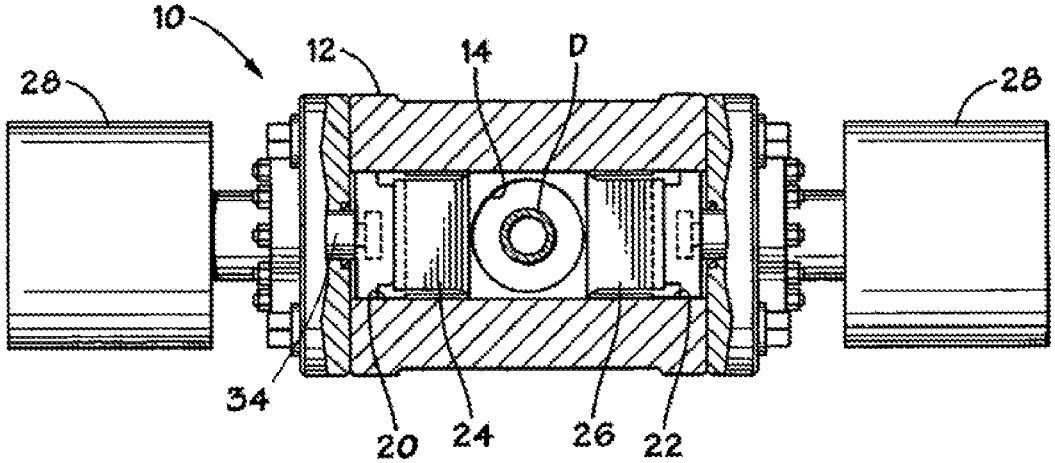
FIG. 1B is a top view of the blowout preventer of FIG. 1A.
Figure 1C:
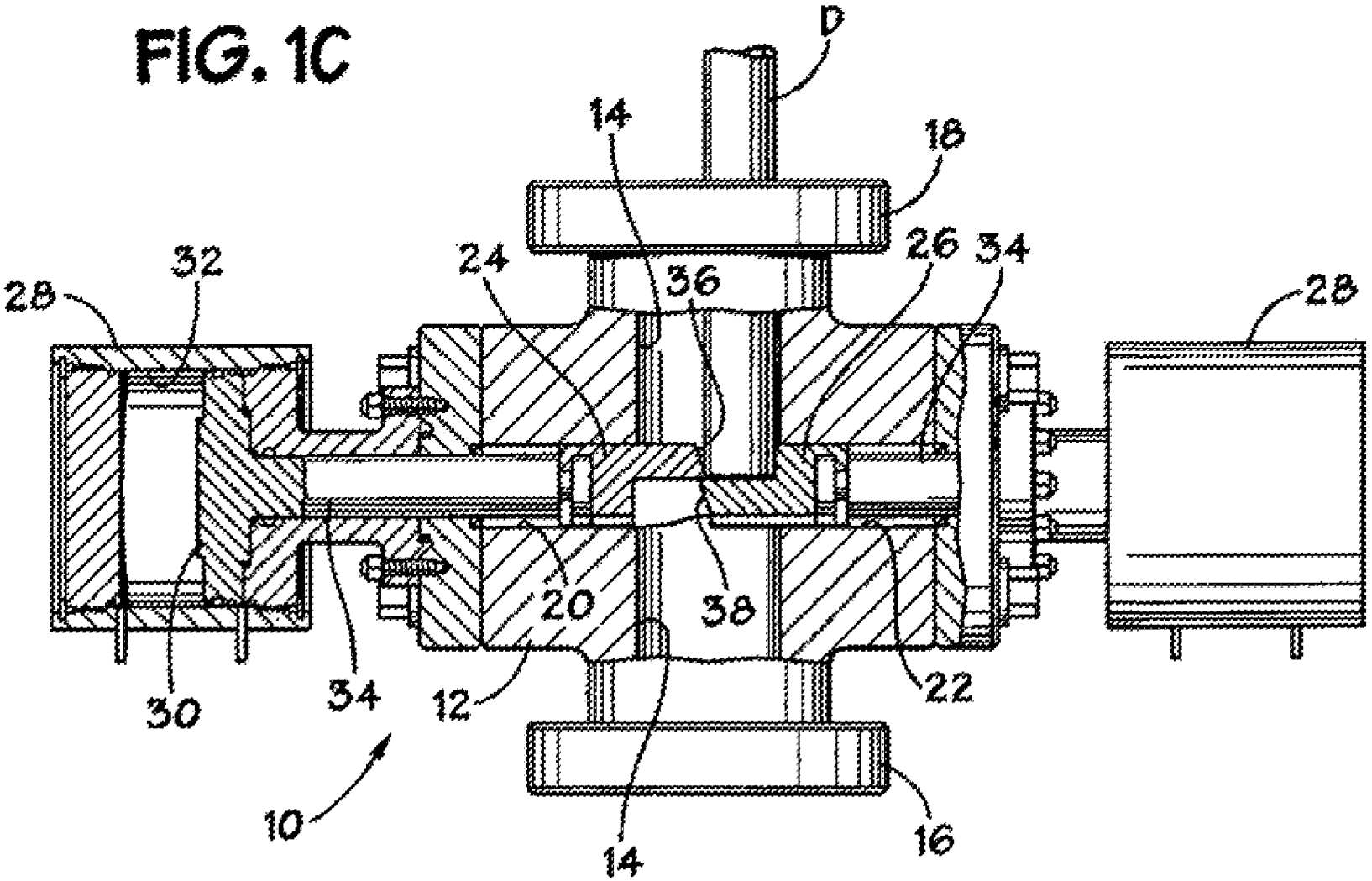
FIG. 1C is a side view, partially in cross-section, of the blowout preventer of FIG. 1A.
Figure 3C:
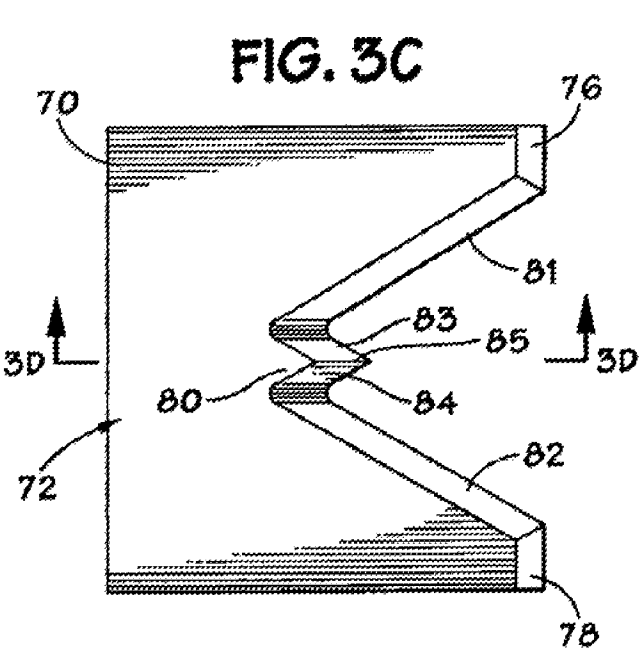
FIG. 3C is a top view of the blade of FIG. 3A.
Figure 3D:
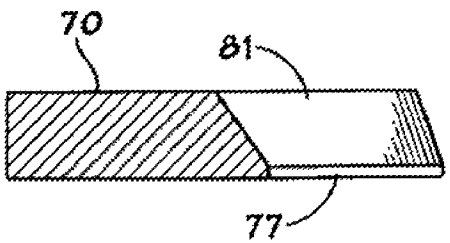
FIG. 3D is a cross-section view along line 3D-3D of FIG. 3A.
Figure 3A:
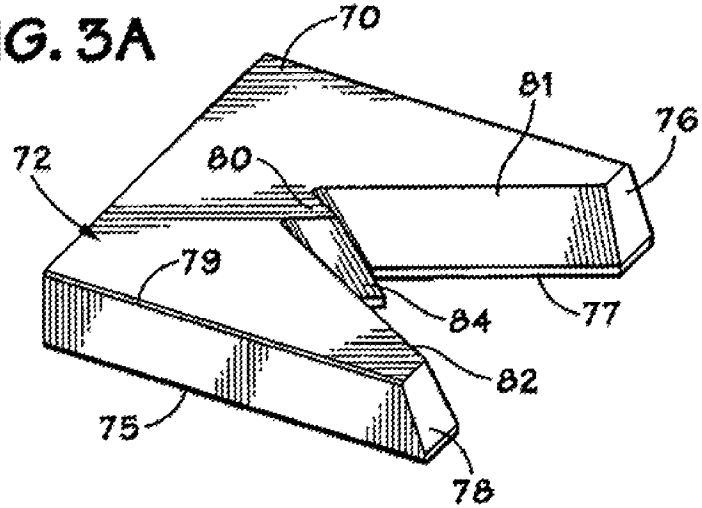
FIG. 3A is a top perspective view of a blade according to the present invention for a blowout preventer according to the present invention.
Figure 3B:
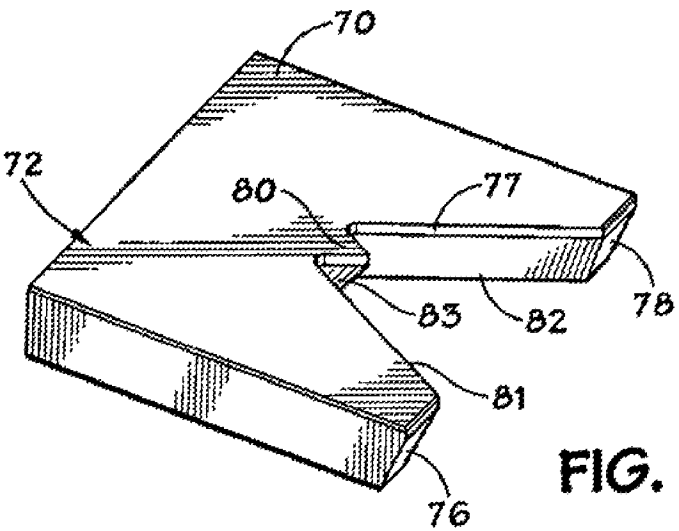
FIG. 3B is a bottom perspective view of the blade of FIG. 3A.
Figure 8C:
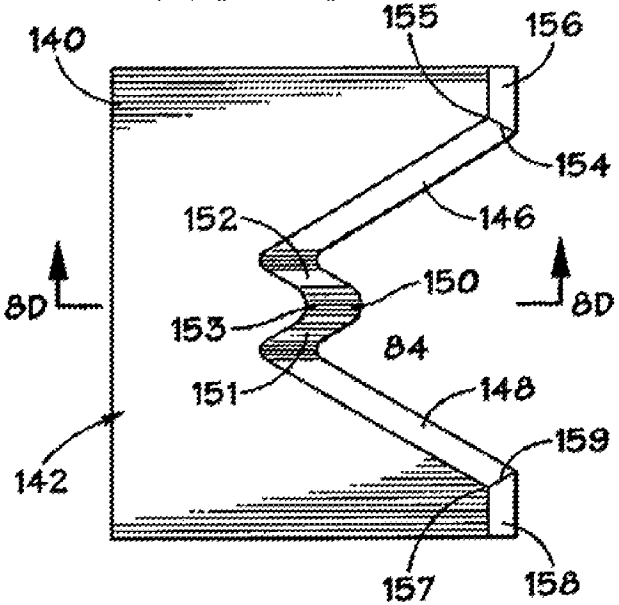
FIG. 8C is a top view of the blade of FIG. 8A.
Figure 8D:
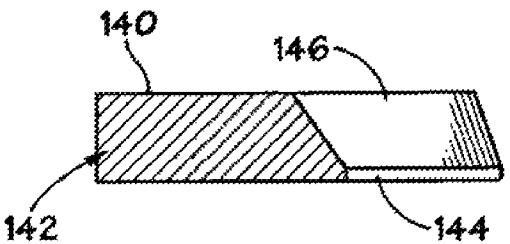
FIG. 8D is a cross-section view along line 8D-8D of FIG. 8A.
Figure 8A:
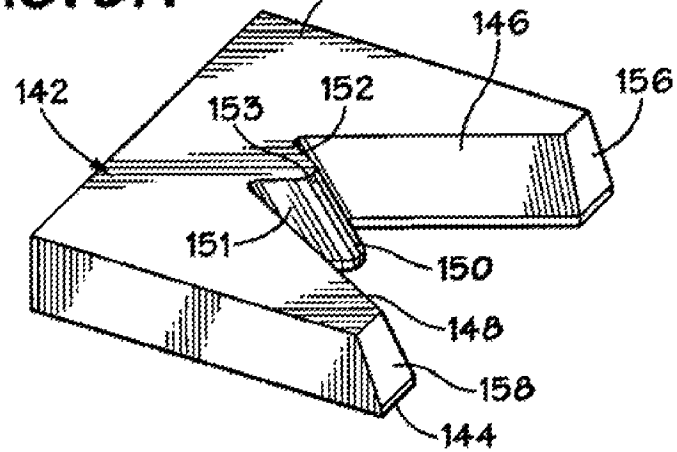
FIG. 8A is a top perspective view of a blade according to the present invention for a blowout preventer according to the present invention.
Figure 8B:
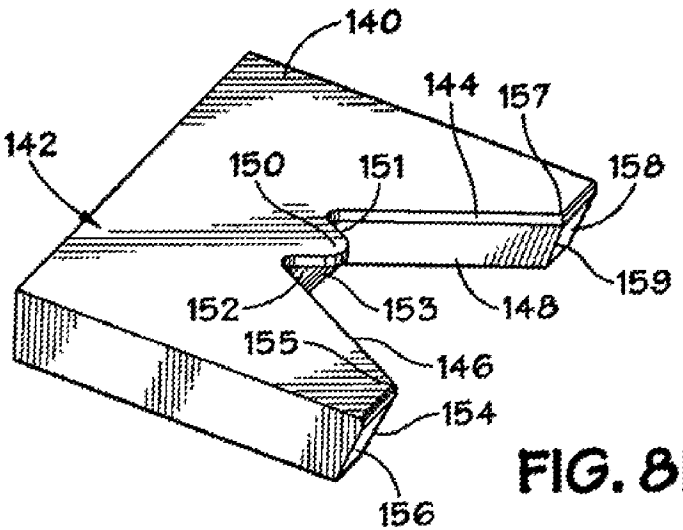
FIG. 8B is a bottom perspective view of the blade of FIG. 8A.

As shown in FIGS. 1A-1C, a blowout preventer 10 according to the present invention has a body 12 with a vertical bore 14 extending therethrough. A tubular, e.g. part of a drill string D passes through the bore 14. The body 12 has a lower flange 16 and an upper flange 18 for connecting the blowout preventer 10 in a wellhead stack. Ram guideways 20 and 22 extend outwardly from opposite sides of the bore 14. Ram assemblies of the blowout preventer 10 include first and second rams 24 and 26 which are positioned in guideways 20 and 22, respectively. Reciprocating apparatus, such as actuators 28, are provided to move or extend the ram in response to fluid pressure into the bore 14 for shearing the portion of the drill string D which extends through the vertical bore and for retracting the ram from the vertical bore. The actuators 28 each include a piston 30 in a cylinder 32 and a rod 34 connecting between the piston 30 and the ram 24 which it is to move and are suitably connected to body 12 as shown. A suitable apparatus is provided to deliver fluid under pressure to opposite sides of piston 30.

An upper cutting blade 36 (any blade according to the present invention) is on the ram 24 and a lower cutting blade 38 (any blade according to the present invention) is on the ram 24. The cutting blades 36 and 38 are positioned so that the cutting edge of the blade 38 passes just below the cutting edge of the blade 36 in shearing of a section of a tubular, e.g. the drill string D.

The shearing action of cutting blades 36 and 38 shears the drill string D (see FIG. 1C). The lower portion of the drill string D has dropped into the well bore (not shown) below the blowout preventer 10. Optionally (as is true for any method according to the present invention) the drill string TD is hung off a lower set of ram.

FIGS. 2A-2D show a blade 50 according to the present invention which has a body 52 with a base 57 and a front face 54. The front face 54 has two inclined portions 61, 62 and a projection 60 that projects from the front face 54 between the two inclined portions 61, 62. Edges 56, 58 are at ends of the inclined portions 61, 62, respectively. The projection 60 has two inclined faces 63, 64 which meet at a central edge 65. An angle 68 between the faces 63, 64 (as may be true for the angle between any two projection faces according to the present invention) may be any desired angle and, in certain aspects, ranges between 30 degrees to 90 degrees and, in certain particular aspects, is 30 degrees, 60 degrees, or 90 degrees.

In certain aspects (as is true for any blade according to the present invention) the cutting surfaces are slopped from the vertical and in one particular aspect, as shown in FIG. 2D, the two inclined portions 61, 62 are at an angle of 20 degrees from the vertical. In other aspects the angle for any cutting surface of any blade according to the present invention ranges between 20 degrees and 60 degrees; and, in certain aspects, the angle is 20 degrees, 45 degrees, or 60 degrees.

FIGS. 3A-3D show a blade 70 according to the present invention which has a body 72 with a base 77, two opposed inclined faces 81, 82 and a projection 80 between the two inclined faces 81, 82. The projection 80 has two inclined faces 83, 84 which meet at a central edge 85. Inclined end portions 76, 78 are at ends of the faces 81, 82 respectively.

FIGS. 4A-4D show a blade 90 according to the present invention with a body 99; opposed inclined faces 91, 92; opposed inclined faces 93, 94; and inclined end portions 95, 96. Projections 97, 98 are formed between faces 91, 93 and 94, 92, respectively. The blade 90 has a base 90*a*.

FIGS. 5A-5D show a blade 100 according to the present invention with a body 100*a*; opposed inclined faces 101, 102; opposed inclined faces 103, 104; and opposed inclined end portions 105, 106. Projections 107, 108 are formed between faces 101, 103 and 104, 102, respectively. The blade 100 has a base 109. Projection 107 has an edge 107*a* and projection 108 has an edge 108*a*.

FIGS. 6A-6D show a blade 110 according to the present invention with a body 110*a*, two inclined faces 111, 112; two opposed inclined faces 113, 114; inclined end portions 115, 116; a central semicircular inclined face 117; and a base 110*b*. Projections 118, 119 are formed between faces 111, 113 and 114, 112, respectively. Projection 118 has an edge 118*a* and projection 119 has an edge 119*a*.

FIGS. 7A-7D show a blade 120 according to the present invention which has a body 122; a base 124; opposed inclined faces 126, 128; inclined faces 132, 134; inclined end portions 136, 138; and a semicircular inclined face 130. A serrated cutting surface 125 extends around a lower edge 127 of the face 130 and extends partially onto the faces 126, 128. As shown the serrations of the surface 125 have pointed tips 129; but, optionally, these tips may be rounded off. The faces 126,132 are at an angle to each other forming a projection 131 with an edge 135. The faces 128, 134 are at an angle to each other forming the projection 133 with an edge 137.

FIGS. 8A-8D show a blade 140 according to the present invention which has a body 142; a base 144; opposed inclined faces 146, 148; a projection 150 between the faces 146, 148; and inclined end portions 156, 158. The projection 150 has inclined faces 151, 152 and a center face 153. A projection 155 is formed between the faces 156, 146 having an edge 154. A projection 157 is formed between the faces 148, 158 having an edge 159. Optionally, as shown, the projection 150 is rounded off.

FIGS. 9A-9D show a blade 160 according to the present invention which has a body 162; a base 164; opposed inclined faces 172, 173; inclined end portions 171, 174; projections 181, 182; and a recess 180 formed between the projections 181, 182. A projection 161 with an edge 163 is formed between the face 172 and the end portion 171. A projection 165 with an edge 167 is formed between the face 173 and the end portion 174. The projection 181 has inclined faces 183, 185 and an inclined center portion 184. The projection 182 has inclined faces 186, 188 and an inclined center portion 187. Optionally, as shown, the projections 181, 182 are rounded off.

Figure 10:
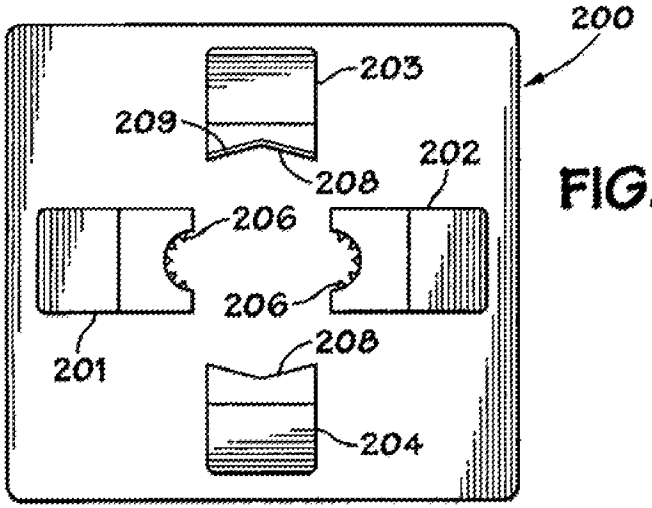
FIG. 10 is a top schematic view of a blowout preventer according to the present invention with blades according to the present invention.

FIG. 10 shows an apparatus 200 for severing a tubular (e.g., but not limited to, drill pipe, drill collar, casing, riser, tubing, and drill pipe tool joints—as is true and can be accomplished with any apparatus herein according to the present invention and with any blade or blades according to the present invention). The apparatus 200 has two alternately movable sets of rams 201, 202 and 203, 204. In one aspect, each ram 201, 202 has a plurality of spaced-apart puncturing points 206 which make a series of corresponding spaced apart holes in a tubular, thereby weakening the tubular and facilitating its complete shearing by blades 208 (any according to the present invention or any known blade) of the rams 203, 204. In certain aspects, there are one, two, three, four, five, six or more points and, optionally, the points may be hardfaced or have hardening material applied thereto (as is true of any blade, blade projection, or blade part disclosed herein according to the present invention regarding hardfacing and/or hardening material). Any such point or points may be used on any blade according to the present invention and/or the blades may be deleted.

Figure 11:
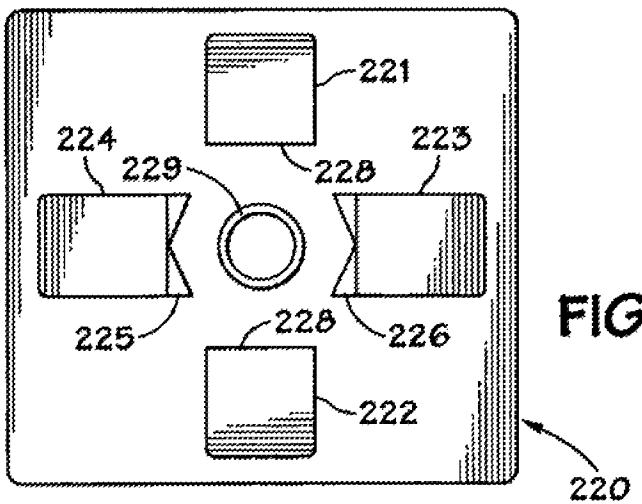
FIG. 11 is a top schematic view of a blowout preventer according to the present invention with blades according to the present invention.

FIG. 11 shows an apparatus 220 according to the present invention which has two sets of movable rams 221, 222 and 223, 224. Rams 221, 222 have flat faces 228 which are used to flatten a tubular 229 ("flatten" means make non-round to any extent as compared to the original round shape of the tubular 229 and includes, but it not limited to, a substantially or totally flattened tubular), e.g. as shown by the dotted line in FIG. 11. Once flattened, the tubular 229 is completely severed by blades 225, 226 on the rams 223, 224, respectively. The blades 225, 226 may be any blade according to the present invention or any known blade.

Figure 12:
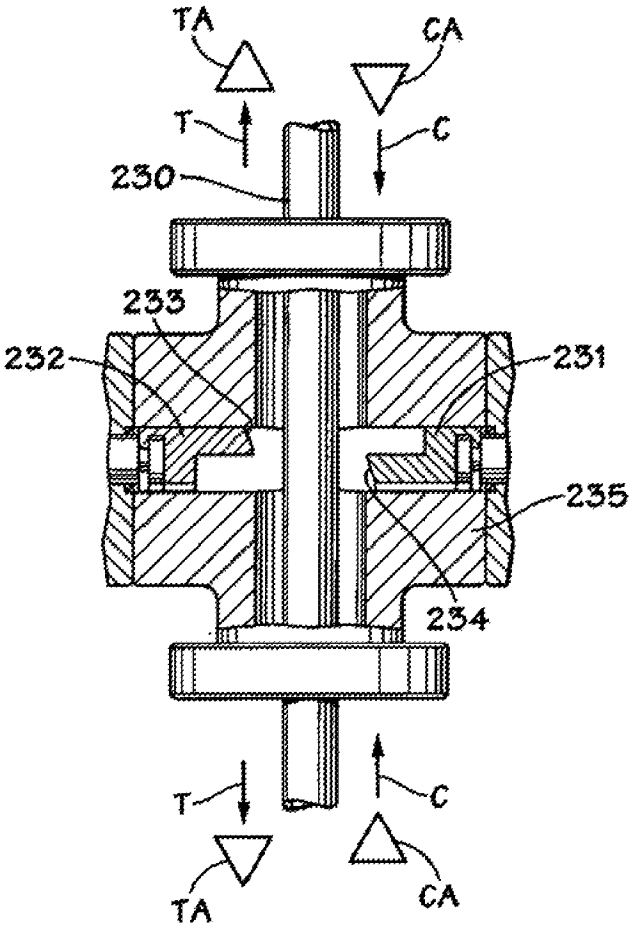
FIG. 12 is a side schematic view of a blowout preventer according to the present invention with blades according to the present invention.

FIG. 12 illustrates a method for severing a tubular 230 by either applying tension T to the tubular lengthwise with a tension applying apparatus TA, shown schematically (see arrows T) or by applying compression to it with a compression applying apparatus CA shown schematically (see arrows C). Ram apparatuses 231, 232 with blades 233, 234 respectively of a blowout preventer 235 are movable to sever the tubular 230.

Optionally, in a two-stroke (or multiple stroke operation) the tubular 230 is put in tension and the blades 233, 234 impact the tubular; then the tubular is put in compression and the blades 233, 234 then completely sever the tubular; or vice-versa. A tensioning step or steps and/or a compression step or steps may be used with any method according to the present invention, including but not limited to, methods as illustrated in FIGS. 10-15.

Figure 13:
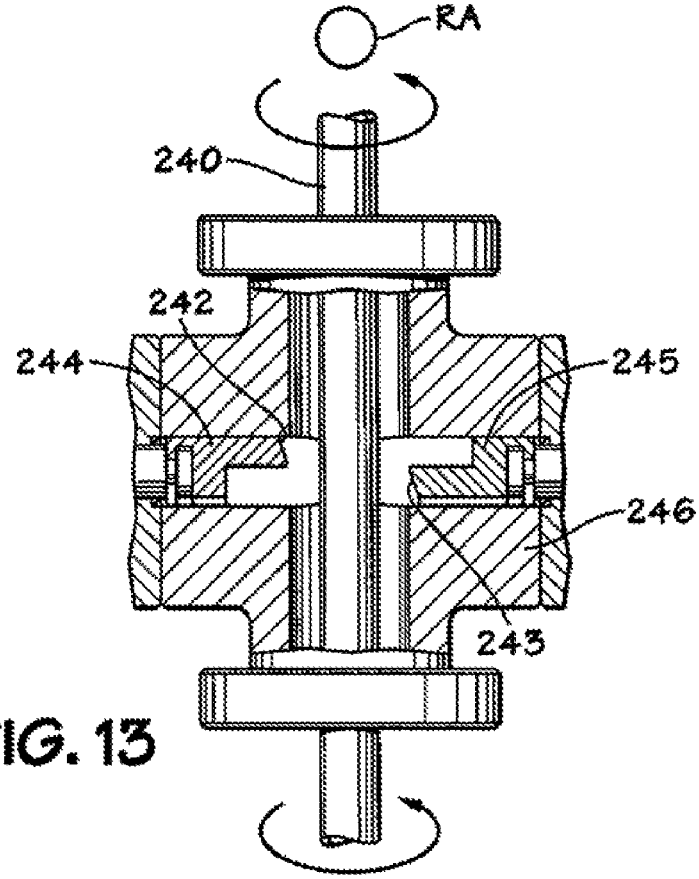
FIG. 13 is a side schematic view of a blowout preventer according to the present invention with blades according to the present invention.

FIG. 13 illustrates a method according to the present invention in which torque is applied to a tubular 240 while it is severed with blades 242, 243 (any blade or blades according to the present invention) of movable ram apparatuses 244, 245 of a blowout preventer 246. Rotation of the tubular 240 can be accomplished by any suitable rotating apparatus above, adjacent, and/or below the tubular, e.g. an apparatus RA (shown schematically in FIG. 13). A torquing step or steps may be used with any method according to the present invention.

Figure 14:
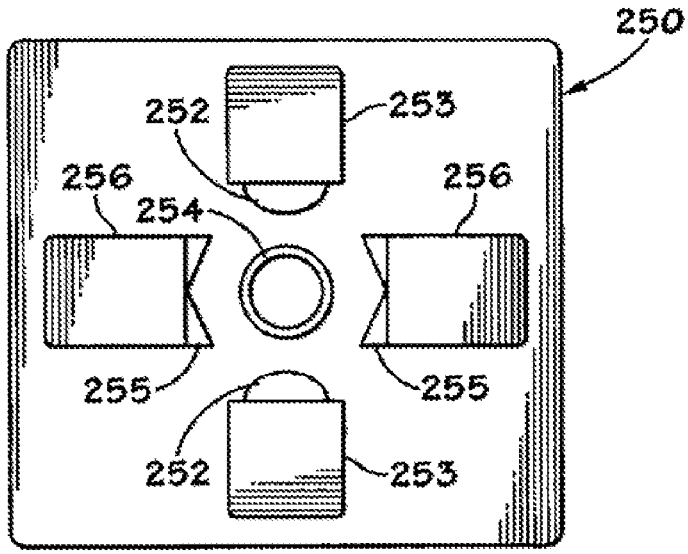
FIG. 14 is a side schematic view of a blowout preventer according to the present invention with blades according to the present invention.

FIG. 14 illustrates a method according to the present invention for either severing a tubular 254 with blades 255 on movable rams 256 within a blowout preventer apparatus 250 using controlled explosive charges 252 in or on movable bodies 253; or a method for weakening a tubular at specific desired locations to facilitate complete severing of the tubular by blade(s) according to the present invention. Optionally, the charges 252 are mounted on the blades 255 or on the rams 256. One, two, three, four or more charges may be used. Any blade according to the present invention or any known blades may be used.

FIGS. 15A-15H illustrate a method according to the present invention using a blowout preventer 300 (depicted schematically, FIG. 15B) according to the present invention (e.g. as any disclosed herein) with movable rams R (shown schematically, FIG. 15B) with blades 301, 302 (blade 301 like blade 302; blade 302 inverted with respect to blade 301—as may be the case with any two blades of any apparatus disclosed herein). Each blade 301, 302 has a body 304 and a central projection 310 with a pointed member 312 and cutting portions 313, 314. Each projection 310 has cutting surfaces 310*a* and 310*b*. The cutting surfaces are sloped from the vertical and the projections 310 have cutting surfaces at an angle to each other. The rams R move the blades so that, initially, the projections 310 contact and puncture a tubular T (e.g. casing, drill pipe, tool joints, drill collars, etc.) and then, following movement of the projections into the tubular T and cutting of the tubular T by the projections 310 and the cutting portions 313, 314, complete severing of the tubular T. The projections 310 are diametrically opposed so that the outermost point of the projections (and then the remainder of the projections) push against each other facilitating puncturing of the tubular and then severing of the tubular. This use of dual opposed puncturing projections also serves to maintain the tubular in a desired location within the blowout preventer 300 during severing so that puncturing and severing proceed with the blades 301, 302 maintained in a desired relation with respect to the tubular T.

Figure 15B:
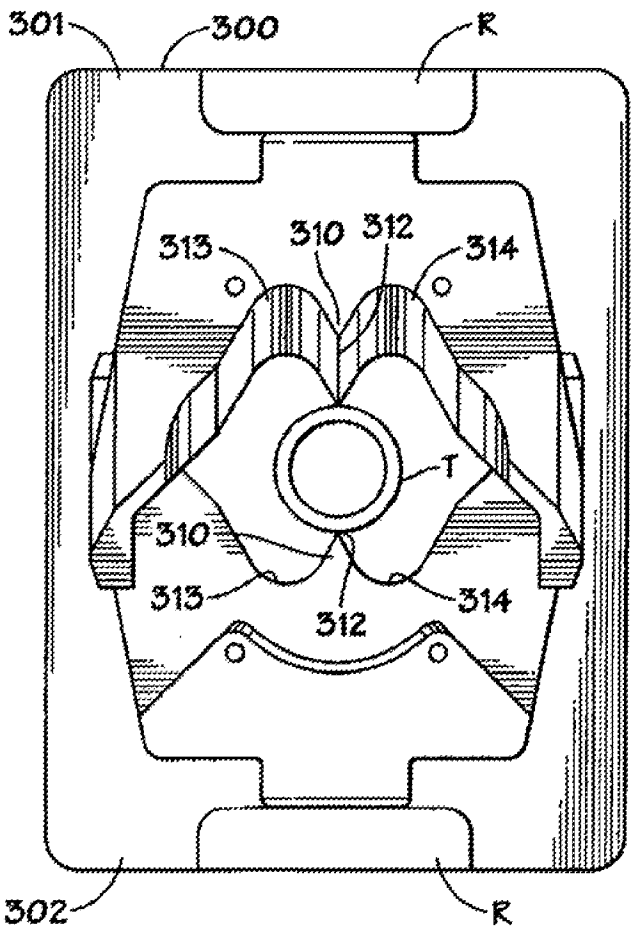
FIG. 15B is a top view that illustrates a step in a method according to the present invention using apparatus according to the present invention.
Figure 15A:
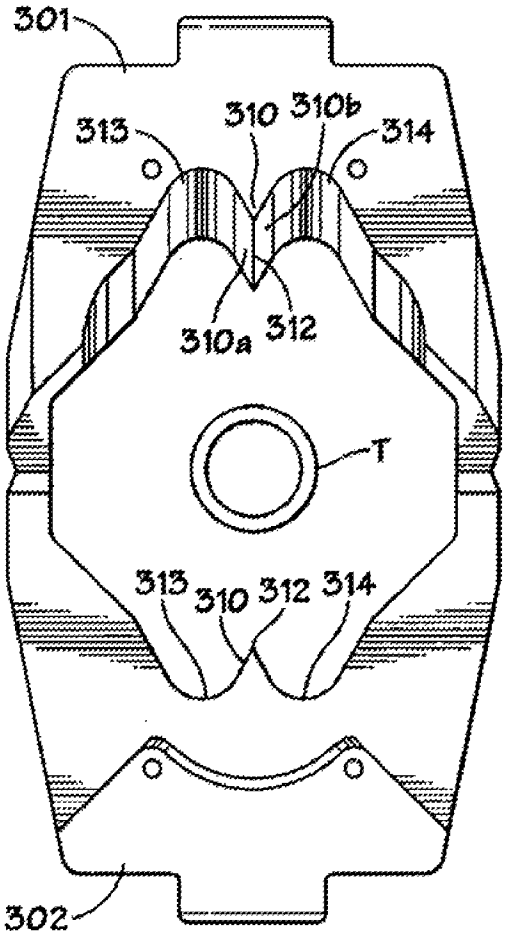
FIG. 15A is a top view that illustrates a step in a method according to the present invention using apparatus according to the present invention.

As shown in FIG. 15B, the points 312 of the projections 310 have moved to contact the outer surface of the tubular T. Upon contact, the points 312 hold the tubular in position. FIG. 15C illustrates initial entry of the points 312 into the tubular T.

As shown in FIG. 15D, the points 312 have penetrated the entire wall thickness of the tubular T and are pushing apart portions T1, T2, and T3, T4. FIG. 15E illustrates further inward progress of the points 312 and further separation of the tubular portions T1, T2 and T3, T4.

As shown in FIG. 15F, as the points 312 progress inwardly and the bottom point 312 (as viewed in FIG. 15F) moves beneath the top point 312, the cutting surfaces 313 and 314 begin to cut the tubular T. The projections 310 cut an amount of the tubular T and the cutting surfaces 313, 314 (and the projections 310 as they progress through the tubular) need cut only the remaining portion of the tubular T to effect complete severing of the tubular T. In certain aspects, and depending on the size of the tubular, the projections 310 can cut the entire tubular.

As shown in FIG. 15G the tubular T is almost completely severed and the top projection 310 has continued to move above the bottom projection 310 as each projection's further piercing of the tubular and the surfaces 313, 314 have continued to further push apart the tubular portions T1, T2, and the portions T3, T4. FIG. 15H shows the tubular T completely severed.

Optionally, only one blade 301 or 302 is used and the other blade has no projection or projections.

As shown in the various drawing figures (e.g. FIGS. 1A, 12, 13, 15A), in some aspects, it is preferred that one blade be inverted with respect to an opposite blade. When a blade with a central projection (or two such blades) are used, cutting surfaces adjacent a cutting projection either cut no tubular at all or only need cut only a fraction of a total wall thickness, circumference of a tubular (unlike, e.g., certain prior "V shear" or "V-shaped" blades in which each cutting surface cuts a much large portion of a tubular).

It is within the scope of the present invention to coat any blade according to the present invention (or any prior blade) or part thereof, and/or cutting surfaces thereof, and/or top and/or bottom thereof, and/or a tubular-puncturing part thereof with a low friction coating, e.g., but not limited to, polytetrafluoroethylene coating, electroless nickel coating, and/or titanium/nickel coating, including but not limited to, low friction coatings applied by a physical vapor deposition ("PVD") process. Such coatings are shown, e.g., as a coating 69 (FIG. 2A) and a coating 209 (FIG. 10) and as a coating 79 (FIG. 3A) on the top of a blade and as a coating 75 (FIG. 3A) on the bottom of a blade, applied by any suitable method or process. These coatings may be applied to any suitable known thickness for the application of low friction coatings.

The present invention, therefore, provides in some, but not in necessarily all, embodiments a blowout preventer with a body with a top, a bottom, and a bore therethrough from the top to the bottom, ram apparatus movable within the body, the ram apparatus including two ram blocks each with a cutting blade according to the present invention.

The present invention, therefore, provides in at least some embodiments, methods for using a blowout preventer according to the present invention.

The present invention, therefore, provides in certain, but not necessarily all embodiments, method including inserting a tubular into a tubular severing apparatus (the apparatus including a first member movable toward the tubular, a second member movable toward the tubular to be severed, the second member disposed opposite to the first member, a first blade on the first member, the first blade comprising a first blade body, a first projection projecting from the first blade body, a first point structure on the first projection for contacting and puncturing the tubular, first projection cutting surfaces on the first projection defining the first point structure and for cutting the tubular, and the first point structure projecting sufficiently from the first blade body so that the first projection can contact the tubular and puncture the tubular before any other part of the first blade body contacts the tubular, and a second blade on the second member); moving the first blade toward the tubular to bring the first point structure into contact with an outer surface of the tubular; moving the first blade so that the first point structure punctures into the tubular and goes through the tubular; moving the first blade to cut a portion of the tubular with the first projection cutting surfaces; and severing the tubular by moving the first blade and the second blade toward each other. Such a method may include one or some, in any possible combination, of the following: wherein the tubular severing apparatus's second blade has a second blade body, a second projection projecting from the second blade body, a second point structure on the second projection for contacting and puncturing the tubular, a second projection cutting surfaces on the second projection defining the point structure and for cutting the tubular, and the second point structure projecting sufficiently from the second blade body so that the second projection can contact the tubular and puncture the tubular before any other part of the second blade body contacts the tubular, the method including moving the second blade toward the tubular as the first blade is moved toward the tubular and moving the second blade so that the second point structure contacts an outer surface of the tubular, moving the second blade so that the second point structure punctures into the tubular and goes through the tubular, and moving the second blade to cut a portion of the tubular with the second projection cutting surfaces; wherein the tubular is severed by the projection cutting surfaces of the first blade and of the second blade; wherein the first blade further comprises first blade cutting surfaces adjacent the first projection, and the second blade comprises second blade cutting surfaces adjacent the second projection, the method including moving the first blade and the second blade so that each blade's blade cutting surfaces cut a portion of the tubular; wherein the first point structure is rounded off; wherein the second point structure is rounded off; wherein the first projection, the first blade cutting surfaces, the second projection, and the second blade cutting surfaces are coated with a low friction coating; wherein the first blade has a top and a bottom and the second blade has a top and a bottom and the tops and bottoms of the two blades are coated with a low friction coating; wherein the first projection is disposed above and opposite the second projection; wherein each of the two point structures contact the tubular substantially simultaneously and puncture the tubular substantially simultaneously; during severing of the tubular, tensioning the tubular with tension apparatus; during severing of the tubular, compressing the tubular with compression apparatus; during severing of the tubular, rotating the tubular with rotating apparatus; prior to any contact between the tubular and either of the blades, flattening the tubular with flattening apparatus; wherein the first blade has a first top and a first bottom, the second blade has a second top and a second bottom, the first projection cutting surfaces slope down from the first top to the first bottom, and the second projection cutting surfaces slope down from the second top to the second bottom; wherein the second blade is inverted with respect to the first blade; wherein the projection cutting surfaces of each blade are at an angle to each other ranging between 30 degrees and 90 degrees; and/or wherein the tubular is from the group consisting of casing, drill pipe, drill collar, and tool joint.

The present invention, therefore, provides in certain, but not necessarily all embodiments, a method for severing a tubular, the tubular useful for well bore operations, the method including: inserting a tubular into a tubular severing apparatus (the apparatus having a first member movable toward the tubular, a second member movable toward the tubular to be severed, the second member disposed opposite to the first member, a first blade on the first member, the first blade comprising a first blade body, a first projection projecting from the first blade body, a first point structure on the first projection for contacting and puncturing the tubular, first projection cutting surfaces on the first projection defining the first point structure and for cutting the tubular, and the first point structure projecting sufficiently from the first blade body so that the first projection can contact the tubular and puncture the tubular before any other part of the first blade body contacts the tubular, and a second blade on the second member); moving the first blade toward the tubular to bring the first point structure into contact with an outer surface of the tubular; moving the first blade so that the first point structure punctures into the tubular and goes through the tubular; moving the first blade to cut a portion of the tubular with the first projection cutting surfaces; severing the tubular by moving the first blade and the second blade toward each other; wherein in the tubular severing apparatus the second blade has a second blade body, a second projection projecting from the second blade body, a second point structure on the second projection for contacting and puncturing the tubular, second projection cutting surfaces on the second projection defining the point structure and for cutting the tubular, and the second point structure projecting sufficiently from the second blade body so that the second projection can contact the tubular and puncture the tubular before any other part of the second blade body contacts the tubular; moving the second blade toward the tubular as the first blade is moved toward the tubular and moving the second blade so that the second point structure contacts an outer surface of the tubular; moving the second blade so that the second point structure punctures into the tubular and goes through the tubular; moving the second blade to cut a portion of the tubular with the second projection cutting surfaces; wherein the first projection is disposed above and opposite the second projection; wherein each of the two point structures contact the tubular substantially simultaneously and puncture the tubular substantially simultaneously; and wherein the second blade is inverted with respect to the first blade.

The present invention, therefore, provides in certain, but not necessarily all embodiments, a tubular severing apparatus for severing a tubular used in well bore operations, the apparatus including: a first member movable toward a tubular to be severed, the tubular comprising a well bore operations tubular; a second member movable toward the tubular to be severed, the second member disposed opposite to the first member; a first blade on the first member, the first blade including a blade body, a projection projecting from a center of the blade body, point structure on the projection for contacting and puncturing the tubular, projection cutting surfaces on the projection defining the point structure and for cutting the tubular, and the point structure projecting sufficiently from the blade body and the projection movable to contact the tubular and puncture the tubular before any other part of the blade body contacts the tubular; and, in one aspect, the second blade like the first blade.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. U.S. application Ser. No. 12/151,279 filed May 5, 2008, is incorporated fully herein for all purposes.

What is claimed is:

1. A blade for severing a tubular of a wellbore, the tubular positionable in a blowout preventer, the blade comprising:

a blade body movable toward and away from the tubular by a ram of the blowout preventer, the blade body comprising:

a cutting surface on front face of the blade body that faces the tubular, the cutting surface comprising a plurality of portions and at least one inclined face, at least one of the plurality of portions being linear; and at least one projection extending a distance from the front face toward the tubular, the at least one projection having a tip positioned between the plurality of portions of the cutting surface;

wherein the blade body is movably positionable through at least a portion of the tubular such that the at least one projection first pierces the tubular and then the cutting surface passes through the tubular such that the at least one of the plurality of linear portions engages the tubular whereby the entire tubular is severed.

2. The blade of claim 1, wherein the tubular is a tool joint.

3. The blade of claim 1, wherein the tubular is a drill collar.

4. The blade of claim 1, wherein the cutting surface pushes apart portions of the tubular adjacent the at least one projection as the at least one projection is moved through the tubular.

5. The blade of claim 1, wherein the at least one inclined face has an incline angle of 30 to 90 degrees.

6. The blade of claim 1, wherein the cutting surface has serrated tips thereon.

7. A system for severing a tubular of a wellbore, the system comprising:

a blowout preventer for receiving the tubular;

at least one pair of opposing blade bodies, each of the at least one pair of opposing blade bodies movable toward and away from the tubular, at least one of the of opposing blade bodies comprising:

a cutting surface on front face of the at least one of the at least one pair of opposing blade bodies that faces the tubular, the cutting surface comprising a plurality of portions and at least one inclined face, at least one of the plurality of portions being linear; and at least one projection extending a distance from the front face toward the tubular, the at least one projection having a tip positioned between the plurality of portions of the cutting surface;

at least one actuator for movably positioning at least one of the opposing blade bodies through at least a portion of the tubular such that the at least one projection first pierces the tubular and then the cutting surface passes through the tubular such that the at least one of the plurality of linear portions engages the tubular whereby the tubular is severed.

8. The system of claim 7, wherein the at least one actuator comprises a piston and a cylinder.

9. The system of claim 7, wherein the at least one pair of opposing blade bodies comprises upper and lower blades.

10. The system of claim 7, wherein the at least one actuator comprises four actuators and wherein the at least pair of the opposing blade bodies comprises four blade bodies, each of the four blade bodies movable by each of the four actuators.

11. The system of claim 7, wherein the at least one pair of opposing blade bodies comprises a plurality of opposing blade bodies positionable on opposite sides of the tubular.

12. The system of claim 7, wherein the at least one of the opposing blade bodies are moveable together to contact and puncture the tubular simultaneously.

13. A method for severing a tubular of a wellbore, comprising:

receiving the tubular in a blowout preventer;

positioning at least one pair of opposing blade bodies in the blowout preventer about the tubular, at least one of the at least one pair of opposing blade bodies comprising:

a cutting surface on a front face of the at least one of the at least one pair of opposing blade bodies that faces the tubular, the cutting surface comprising a plurality of portions and at least one inclined face, at least one of the plurality of portions being linear; and at least one projection extending a distance from the front face toward the tubular, the at least one projection having a tip positioned between the plurality of portions of the cutting surface; and movably positioning at least one of the opposing blade bodies through at least a portion of the tubular by first piercing the tubular with the at least one projection and then passing the cutting surface through the tubular such that the at least one of the plurality of linear portions engages the tubular.

14. The method of claim 13, wherein the step of movably positioning comprises moving the at least one pair of opposing blade bodies together such that the at least one projections of the pair of opposing blade bodies first pierces the tubular and then the cutting surfaces of the at least one pair of opposing blade bodies pass through the tubular.

15. The method of claim 14, further comprising pushing apart portions of the tubular as the at least one pair of opposing blade bodies move together.

16. The method of claim 15, further comprising cutting portions of the tubular with the cutting surface after pushing apart portions of the tubular.

17. The method of claim 13, further comprising applying a torque to the tubular.

18. The method of claim 13, further comprising compressing the tubular.

19. The method of claim 13, further comprising repeating the method.

* * * * *

UNITED STATES PATENT AND TRADEMARK OFFICE

CERTIFICATE OF CORRECTION

PATENT NO. : 8,066,070 B2
APPLICATION NO. : 12/883469
DATED : November 29, 2011
INVENTOR(S) : Frank Benjamin Springett and James Dennis Brugman It is certified that error appears in the above-identified patent and that said Letters Patent is hereby corrected as shown below:

Column 11, line 13 in Claim 1, the words "a cutting surface on front face of the blade body that" should read -- a cutting surface on a front face of the blade body that --.

Column 11, line 42 in Claim 7, the words "and away from the tubular, at least one of the of opposing" should read -- and away from the tubular, at least one of the at least one pair of opposing --.

Column 11, line 44 in Claim 7, the words "a cutting surface on front face of the at least one of the" should read -- a cutting surface on a front face of the at least one of the --.

Column 12, line 8 in Claim 10, the words "comprises four actuators and wherein the at least pair of the" should read -- comprises four actuators and wherein the at least one pair of the --.

Column 12, lines 15 in Claim 12, the words "opposing blade bodies are moveable together to contact and" should read -- opposing blade bodies are movable together to contact and --.

Column 12, line 40 in Claim 14, the words "ing blade bodies together such that the at least one projections" should read -- ing blade bodies together such that the at least one projection --.

Signed and Sealed this
Twenty-ninth Day of May, 2012

David J. Kappos

David J. Kappos
*Director of the United States Patent and Trademark Office*